US006967275B2

(12) United States Patent
Ozick

(10) Patent No.: US 6,967,275 B2
(45) Date of Patent: Nov. 22, 2005

(54) SONG-MATCHING SYSTEM AND METHOD

(75) Inventor: Daniel Ozick, Newton, MA (US)

(73) Assignee: iRobot Corporation, Burlington, MA (US)

( * ) Notice: Subject to any disclaimer, the term of this patent is extended or adjusted under 35 U.S.C. 154(b) by 242 days.

(21) Appl. No.: 10/602,845

(22) Filed: Jun. 24, 2003

(65) Prior Publication Data

US 2003/0233930 A1 Dec. 25, 2003

Related U.S. Application Data

(60) Provisional application No. 60/397,955, filed on Jul. 22, 2002, and provisional application No. 60/391,553, filed on Jun. 25, 2002.

(51) Int. Cl.[7] ..... G10H 7/00

(52) U.S. Cl. ..... 84/616; 84/609; 434/307 A

(58) Field of Search ..... 84/609, 616, 654; 434/307 A

(56) References Cited

U.S. PATENT DOCUMENTS 5,402,339 A * 3/1995 Nakashima et al. ..... 707/1
5,428,708 A * 6/1995 Gibson et al. ..... 704/270
5,510,572 A * 4/1996 Hayashi et al. ..... 84/609
5,739,451 A * 4/1998 Winksy et al. ..... 84/609
5,874,686 A * 2/1999 Ghias et al. ..... 84/609
5,925,843 A * 7/1999 Miller et al. ..... 84/609
6,188,010 B1 * 2/2001 Iwamura ..... 84/609
6,437,227 B1 * 8/2002 Theimer ..... 84/609
6,476,306 B2 * 11/2002 Huopaniemi et al. ..... 84/609
6,504,089 B1 * 1/2003 Nagasawa et al. ..... 84/609
6,528,715 B1 * 3/2003 Gargi ..... 84/615
6,678,680 B1 * 1/2004 Woo ..... 707/6
6,772,113 B1 * 8/2004 Fujita et al. ..... 704/219

* cited by examiner

*Primary Examiner*—Jeffrey W Donels
(74) *Attorney, Agent, or Firm*—Goodwin Procter LLP

(57) ABSTRACT

A song-matching system, which provides real-time, dynamic recognition of a song being sung and providing an audio accompaniment signal in synchronism therewith, includes a song database having a repertoire of songs, each song of the database being stored as a relative pitch template, an audio processing module operative in response to the song being sung to convert the song being sung into a digital signal, an analyzing module operative in response to the digital signal to determine a definition pattern representing a sequence of pitch intervals of the song being sung that have been captured by the audio processing module, a matching module operative to compare the definition pattern of the song being sung with the relative pitch template of each song stored in the song database to recognize one song in the song database as the song being sung, the matching module being further operative to cause the song database to download the unmatched portion of the relative pitch template of the recognized song as a digital accompaniment signal; and a synthesizer module operative to convert the digital accompaniment signal to the audio accompaniment signal that is transmitted in synchronism with the song being sung.

14 Claims, 4 Drawing Sheets

SONG-MATCHING SYSTEM AND METHOD

CROSS REFERENCE TO RELATED APPLICATIONS

This application claims the benefit of U.S. Provisional Application Ser. No. 60/391,553, filed Jun. 25, 2002, and U.S. Provisional Application Ser. No. 60/397,955, filed Jul. 22, 2002.

FIELD OF THE INVENTION

The present invention relates generally to musical systems, and, more particularly, to a musical system that "listens" to a song being sung, recognizes the song being sung in real time, and transmits an audio accompaniment signal in synchronism with the song being sung.

BACKGROUND OF THE INVENTION

Prior art musical systems are known that transmit songs in response to a stimulus, that transmit known songs that can be sung along with, and that identify songs being sung. With respect to the transmission of songs in response to a stimuli, many today's toys embody such musical systems wherein one or more children's songs are sung by such toys in response to a specified stimulus to the toy, e.g., pushing a button, pulling a string. Such musical toys may also generate a corresponding toy response that accompanies the song being sung, i.e., movement of one or more toy parts. See, e.g., Japanese Publication Nos. 02235086A and 2000232761A.

Karaoke musical systems, which are well known in the art, are systems that allow a participant to sing along with a known song, i.e., the participant follows along with the words and sounds transmitted by the karaoke system. Some karaoke systems embody the capability to provide an orchestral or second-vocal accompaniment to the karaoke song, to provide a harmony accompaniment to the karaoke song, and/or to provide pitch adjustments to the second-vocal or harmony accompaniments based upon pitch of the lead singer. See, e.g., U.S. Pat. Nos. 5,857,171, 5,811,708, and 5,447,438.

Other musical systems have the capability to process a song being sung for the purpose of retrieving information relative to such song, e.g., title, from a music database. For example, U.S. Pat. No. 6,121,530 describes a web-based retrieval system that utilizes relative pitch values and relative span values to retrieve a song being sung.

None of the foregoing musical systems, however, provides an integrated functional capability wherein a song being sung is recognized and an accompaniment, e.g., the recognized song, is then transmitted in synchronism with the song being song. Accordingly; a need exists for a song-matching system that encompasses the capability to recognize a song being sung and to transmit an accompaniment, e.g., the recognized song, in synchronism with the song being sung.

SUMMARY OF THE INVENTION

One object of the present invention is to provide a real-time, dynamic song-matching system and method to determine a definition pattern of a song being sung representing that sequence of pitch intervals of the song being sung that have been captured by the song-matching system.

Another object of the present invention is to provide a real-time, dynamic song-matching system and method to match the definition pattern of the song being sung with the relative pitch template each song stored in a song database to recognize one song in the song database as the song being sung.

Yet a further object of the present invention is to provide a real-time, dynamic song-matching system and method to convert the unmatched portion of the relative pitch template of the recognized song to an audio accompaniment signal that is transmitted from an output device of the song-matching system in synchronism with the song being sung.

These and other objects are achieved by a song-matching system that provides real-time, dynamic recognition of a song being sung and provides an audio accompaniment signal in synchronism therewith, the system including a song database having a repertoire of songs, each song of the database being stored as a relative pitch template, an audio processing module operative in response to the song being sung to convert the song being sung into a digital signal, an analyzing module operative in response to the digital signal to determine a definition pattern representing a sequence of pitch intervals of the song being sung that have been captured by the audio processing module, a matching module operative to compare the definition pattern of the song being sung with the relative pitch template of each song stored in the song database to recognize one song in the song database as the song being sung, the matching module being further operative to cause the song database to download the unmatched portion of the relative pitch template of the recognized song as a digital accompaniment signal; and a synthesizer module operative to convert the digital accompaniment signal to the audio accompaniment signal that is transmitted in synchronism with the song being sung.

BRIEF DESCRIPTION OF THE DRAWINGS

These and other objects, features, and advantages of the present invention will be apparent from the following detailed description of preferred embodiments of the present invention in conjunction with the accompanying drawings wherein.

DETAILED DESCRIPTION OF THE INVENTION

Figure 1:
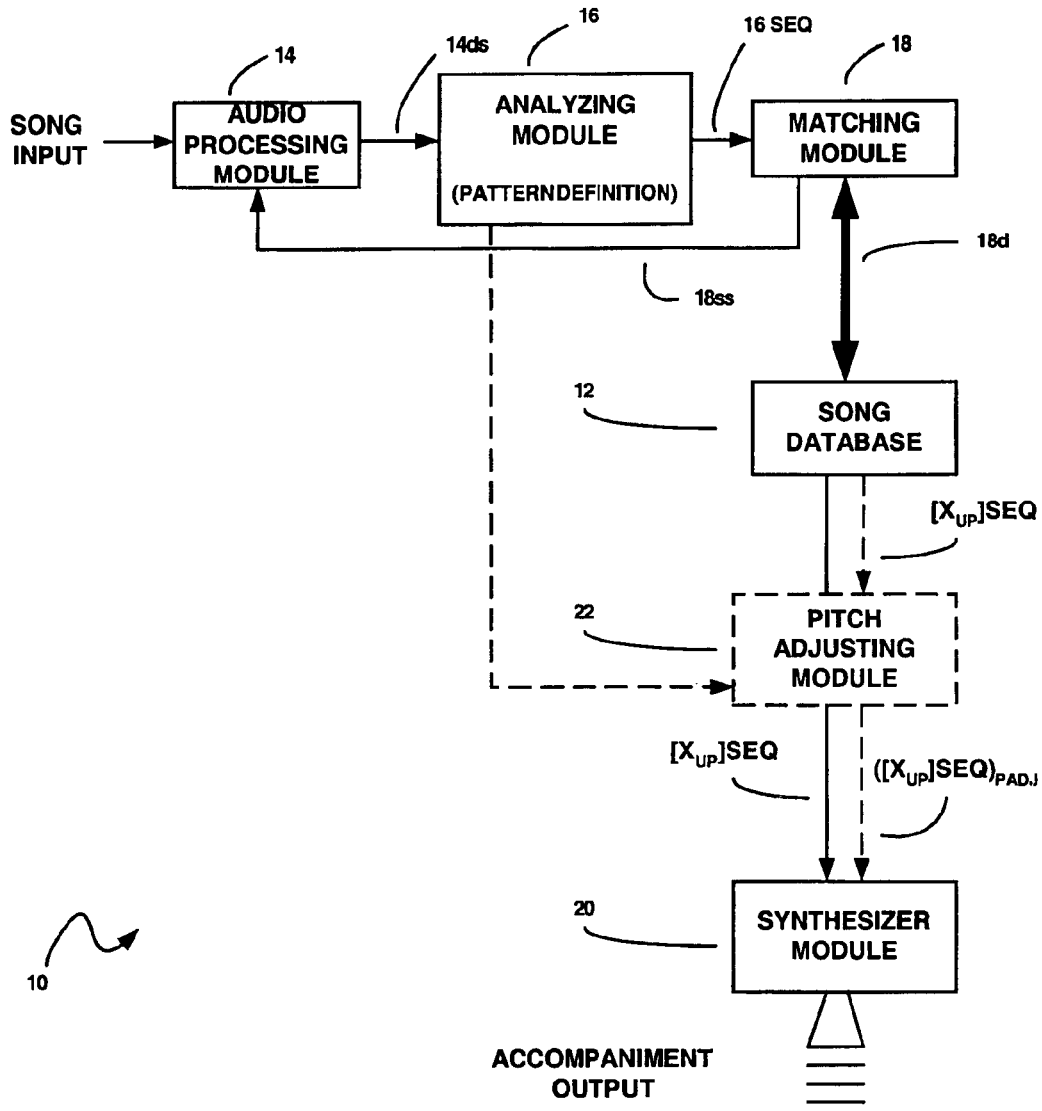
FIG. 1 illustrates a block diagram of an exemplary embodiment of a song-matching system according to the present invention.
Figure 2:
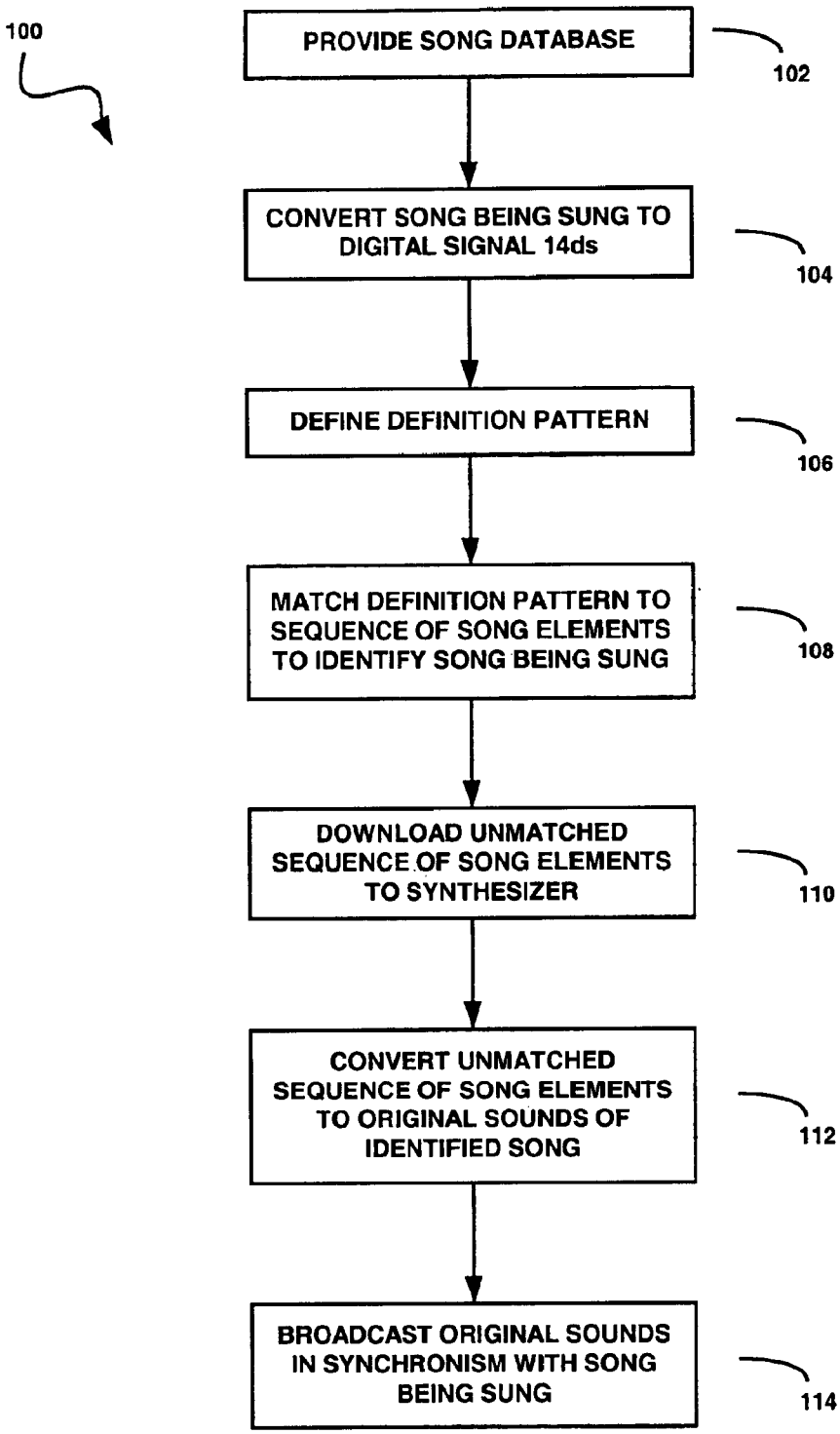
FIG. 2 illustrates one preferred embodiment of a method for implementing the song-matching system according to the present invention.

Referring now to the drawings wherein like reference numerals represent corresponding or similar elements or steps throughout the several views, FIG. 1 is a block diagram of an exemplary embodiment of a song-matching system 10 according to the present invention. The song-matching system 10 is operative to provide real-time, dynamic song recognition of a song being sung and to transmit an accompaniment in synchronism with the song being sung. The song-matching system 10 can be incorporated into a toy such as a doll or stuffed animal so that the toy transmits the accompaniment in synchronism with a song being sung by a child playing with the toy. The song-matching system 10 can also be used for other applications. The general architecture of a preferred embodiment of the present invention comprises a microphone for audio input, an analog and/or digital signal processing system including a microcontroller, and a loudspeaker for output. In addition, the system includes a library or database of songs-typically between three and ten songs, although any number of songs can be stored.

As seen in FIG. 1, the song-matching system 10 comprises a song database 12, an audio processing module 14, an analyzing module 16, a matching module 18, and a synthesizer module 20 that includes an output device OD, such as a loudspeaker. In another embodiment of the present invention, the song-matching system 10 further includes a pitch-adjusting module 22, which is illustrated in FIG. 1 in phantom format. These modules may consist of hardware, firmware, software, and/or combinations thereof.

The song database 12 comprises a stored repertoire of prerecorded songs that provide the baseline for real-time, dynamic song recognition. The number of prerecorded songs forming the repertoire may be varied, depending upon the application. Where the song-matching system 10 is incorporated in a toy, the repertoire will typically be limited to five or less songs because young children generally only know a few songs. For the described embodiment, the song repertoire consists of four songs[X]: song[0], song[1], song [2], and song[3].

Each song[X] is stored in the database 12 as a relative pitch template $TMP_{RP}$, i.e., as a sequence of frequency differences/intervals between adjacent pitch events. The relative pitch templates $TMP_{RP}$ of the stored songs [X] are used in a pattern-matching process to identify/recognize a song being sung.

By way of illustration of the preferred embodiment, because a singer may choose almost any starting pitch (that is, sing in any key), the system 10 stores the detected input notes as relative pitches, or musical intervals. In the instant invention, it is the sequence of intervals not absolute pitches that define the perception of a recognizable melody. The relative pitch of the first detected note is defined to be zero; each note is then assigned a relative pitch that is the difference in pitch between it and the previous note.

Similarly, the songs in the database 12 are represented as note sequences of relative pitches in exactly the same way. In other embodiments, the note durations can be stored as either absolute time measurements or as relative durations.

Figure 3:
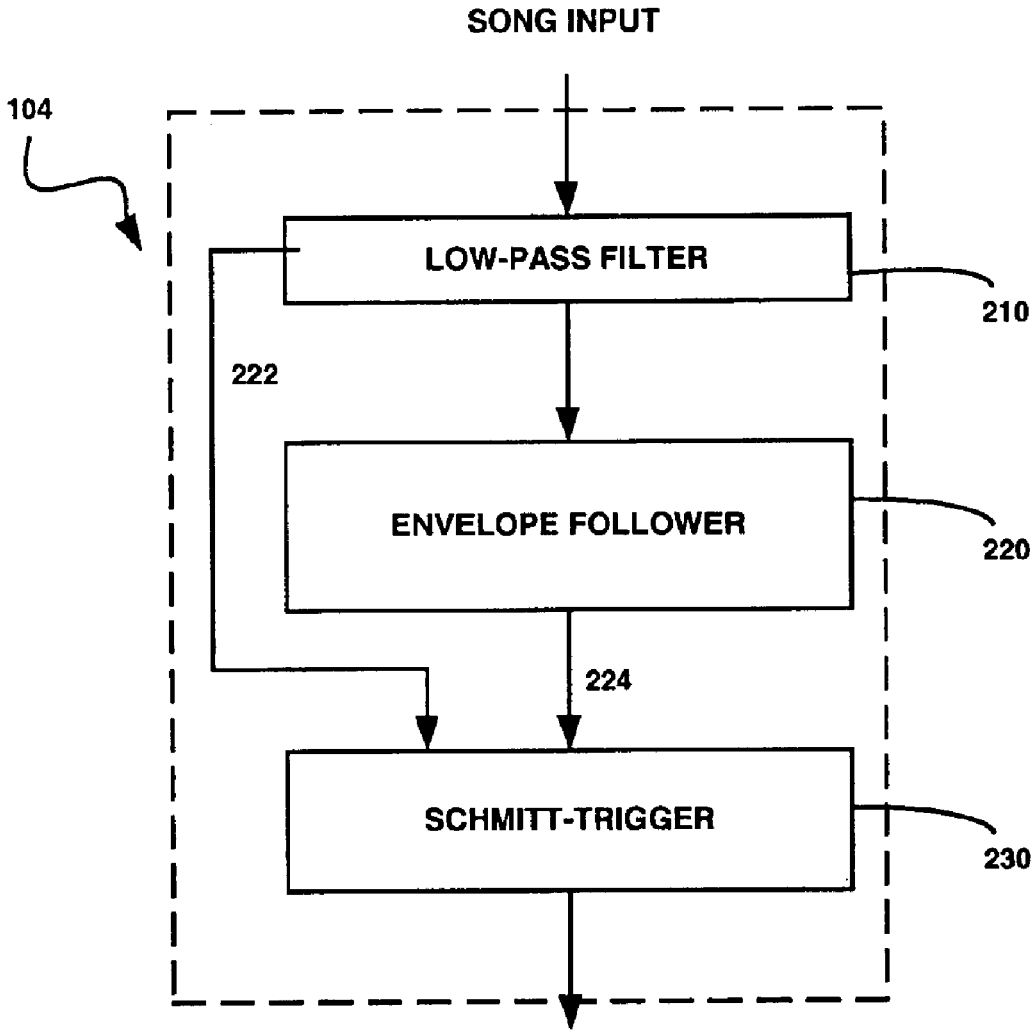
FIG. 3 illustrates one preferred embodiment of sub-steps for the audio processing module for converting input into a digital signal.

The audio processing module 14 is operative to convert the song being sung, i.e., a series of variable acoustical waves defining an analog signal, into a digital signal 14*ds*. An example of an audio processing module 14 that can be used in the song-matching system 10 of the present invention is illustrated in FIG. 3.

Figure 4:
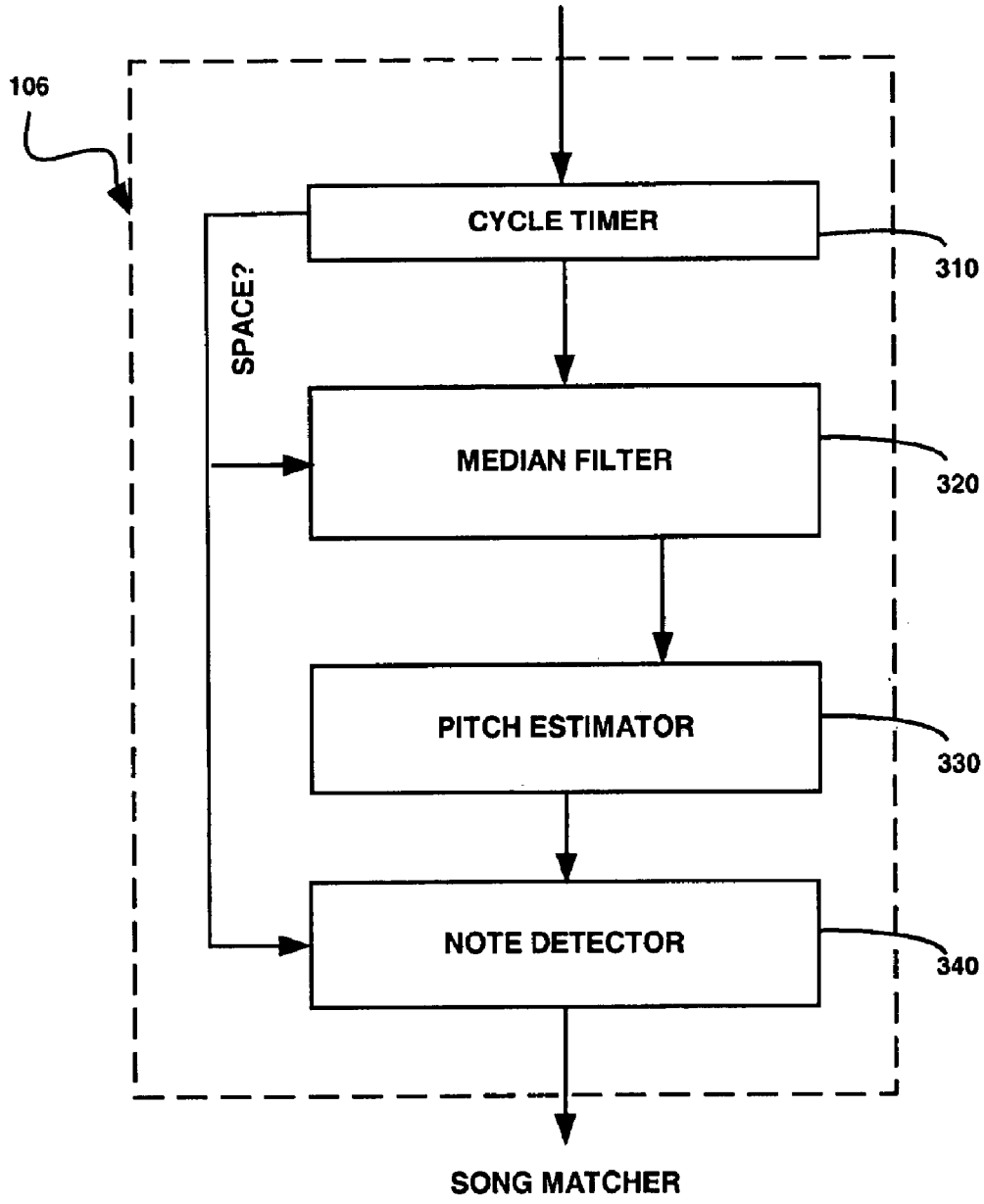
FIG. 4 illustrates one preferred embodiment of sub-steps for the analyzing module for defining input as a string of definable note intervals.

The analyzing module 16 is operative, in response to the digital signal 14*ds*, to: (1) detect the values of individual pitch events; (2) determine the interval (differential) between adjacent pitch events, i.e., relative pitch; and (3) determine the duration of individual pitch events, i.e., note identification. Techniques for analyzing a digital signal to identify pitch event intervals and the duration of individual pitch events are know to those skilled in the art. See, for example, U.S. Pat. Nos. 6,121,520, 5,857,171, and 5,447,438. The output from the analyzing module 16 is a sequence $\mathbf{16}PI_{SEQ}$ of pitch intervals (relative pitch) of the song being sung that has been captured by the audio processing module 14 of the song-matching system 10. This output sequence $\mathbf{16}PI_{SEQ}$ defines a definition pattern used in the pattern-matching process implemented in the matching module 18. An example of an analyzing module 16 that can be used in the song-matching system 10 of the present invention is illustrated in FIG. 4.

The matching module 18 is operative, in response to the definition pattern $\mathbf{16}PI_{SEQ}$, to effect real-time pattern matching of the definition pattern $\mathbf{16}PI_{SEQ}$ against the relative pitch templates $TMP_{RP}$ of the songs [X] stored in the song database 12. That is, the templates $[0]TMP_{RP}$, $[1]TMP_{RP}$, $[2]TMP_{RP}$, and $[3]TMP_{RP}$ corresponding to song[0], song [1], song[2], and song[3], respectively.

For the preferred embodiment of the song-matching system 10, the matching module 18 implements the pattern-matching algorithm in parallel. That is, the definition pattern $\mathbf{16}PI_{SEQ}$ is simultaneously compared against the templates of all prerecorded songs $[0]TMP_{RP}$, $[1]TMP_{RP}$, $[2]TMP_{RP}$, and $[3]TMP_{RP}$. Parallel pattern-matching greatly improves the response time of the song matching system 10 to identify the song being sung. One skilled in the art will appreciate, however, that the song-matching system 10 of the present invention could utilize sequential pattern matching wherein the definition pattern $\mathbf{16}PI_{SEQ}$ is compared to the relative pitch templates of the prerecorded songs $[0]TMP_{RP}$, $[1]TMP_{RP}$, $[2]TMP_{RP}$, and $[3]TMP_{RP}$ one at a time, i.e., the definition pattern $\mathbf{16}PI_{SEQ}$ is compared to the template $[0]TMP_{RP}$, then to the template $[1]TMP_{RP}$ and so forth.

The pattern-matching algorithm implemented by the matching module 18 is also operative to account for the uncertainties inherent in a pattern-matching song recognition scheme. That is, these uncertainties make it statistically unlikely that a song being sung would ever be pragmatically recognized with one hundred percent certainty. Rather, these uncertainties are accommodated by establishing a predetermined confidence level for the song-matching system 10 that provides song recognition at less than one hundred percent certainty, but at a level that is pragmatically effective by implementing a confidence-determination algorithm in connection with each pattern-matching event, i.e., one comparison of the definition pattern $\mathbf{16}PI_{SEQ}$ against the relative pitch templates $TMP_{RP}$ of each of the songs [X] stored in the song database 12. This feature has particular relevance in connection with a song-matching system 10 that is incorporated in children's' toys since the lack of singing skills in younger children may give rise to increased uncertainties in the pattern-matching process. This confidence analysis mitigates uncertainties such as variations in pitch intervals and/or duration of pitch events, interruptions in the song being sung, and uncaptured pitch events of the song being sung.

For the initial pattern-matching event, the matching module 18 assigns a 'correlation' score to each prerecorded song [X] based upon the degree of correspondence between the definition pattern, $\mathbf{16}PI_{SEQ}$ and the relative pitch template $[X]TMP_{RP}$ thereof where a high correlation score is indicative of high degree of correspondence between the definition pattern $\mathbf{16}PI_{SEQ}$ and the relative pitch template $[X]TMP_{RP}$. For the embodiment of the song-matching system 10 wherein the song database 12 includes four songs[0], [1], [2], and [3], the matching module 18 would assign a correlation score to each of the definition pattern $\mathbf{16}PI_{SEQ}$, relative pitch template $[X]TMP_{RP}$ combinations. That is, a correlation score [0] for the definition pattern $\mathbf{16}PI_{SEQ}$—relative pitch template $[0]TMP_{RP}$ combination, a correlation score [1] for the definition pattern $\mathbf{16}PI_{SEQ}$—relative pitch template $[1]TMP_{RP}$ combination, a correlation score [2] for the definition pattern $\mathbf{16}PI_{SEQ}$—relative pitch template $[2]TMP_{RP}$ combination, and a correlation score [3] for the definition pattern 16$PI_{SEQ}$—relative pitch template [3]$TMP_{RP}$ combination. The matching module 18 then processes these correlation scores [X] to determine whether one or more of the correlation scores [X] meets or exceeds the predetermined confidence level.

If no correlation score [X] meets or exceeds the predetermined confidence level, or if more than one correlation score [X] meets or exceeds the predetermined confidence level (in the circumstance where one or more relative pitch templates [X]$TMP_{RP}$ apparently possess initial sequences of identical or similar pitch intervals), the matching module 18 may initiate another pattern-matching event using the most current definition pattern 16$PI_{SEQ}$. The most current definition pattern 16$PI_{SEQ}$ includes more captured pitch intervals, which increases the statistical likelihood that only a single correlation score [X] will exceed the predetermined confidence level in the next pattern-matching event. The matching module 18 implements pattern-matching events as required until only a single correlation score [X] exceeds: the predetermined confidence level.

Selection of a predetermined confidence level, where the predetermined confidence level establishes pragmatic 'recognition' of the song being sung, for the song-matching system 10 depends upon a number of factors, such as the complexity of the relative pitch templates [X]$TMP_{RP}$ stored in the song database 12 (small variations in relative pitch being harder to identify than large variations in relative pitch), tolerances associated with the relative pitch templates [X]$TMP_{RP}$ and/or the pattern-matching process, etc. A variety of confidence-determination models can be used to define how correlation scores [X] are assigned to the definition pattern 16$PI_{SEQ}$, relative pitch template [X]$TMP_{RP}$ combinations and how the predetermined confidence level is established. For example, the ratio or linear differences between correlation scores may be used to define the predetermined confidence level, or a more complex function may be used. See, e.g., U.S. Pat. No. 5,566,272 which describes confidence measures for automatic speech recognition systems that can be adapted for use in conjunction with the song-matching system 10 according to the present invention. Other schemes for establishing confidence levels are known to those skilled in the art.

Once the pattern-matching process implemented by the matching module 18 matches or recognizes one prerecorded song [$X_M$] in the song database 12 as the song being sung, i.e., only one correlation score [X] exceeds the predetermined confidence level, the matching module 18 simultaneously transmits a download signal 18*ds* to the song database 12 and a stop signal l8*ss* to the audio processing circuit 14.

This download signal 18ds causes the unmatched portion of the relative pitch template [$X_M$]$TMP_{RP}$ of the recognized song[$X_I$] to be downloaded from the song database 12 to the synthesizer module 20. That is, the pattern-matching process implemented in the-matching module 18 has pragmatically determined that the definition pattern 16$PI_{SEQ}$ matches a first portion of the relative pitch template [X]$TMP_{RP}$. Since the definition pattern 16$PI_{SEQ}$ corresponds to that portion of the song being sung that has already been sung, i.e., captured by the audio processing module 14 of the song-matching system 10, the unmatched portion of the relative pitch template [$X_M$]$TMP_{RP}$ of the recognized song [$X_I$] corresponds to the remaining portion of the song being sung that has yet to be sung. That is, relative pitch template [$X_M$] $TMP_{RP}$—definition pattern 16$PI_{SEQ}$=the remaining portion of the song being sung that has yet to be sung. To simplify the remainder of the discussion, this unmatched portion of the relative pitch template [$X_M$]$TMP_{RP}$ of the recognized song [$X_M$] is identified as the accompaniment signal $S_{ACC}$.

The synthesizer module 20 is operative, in response to the downloaded accompaniment signal $S_{ACC}$, to convert this digital signal into an accompaniment audio signal that is transmitted from the output device OD in synchronism with the song being sung. In the preferred embodiment of the song-matching system 10 according to the present invention, the accompaniment audio signal comprises the original sounds of the recognized song [$X_M$], which are transmitted from the output device OD in synchronism with the song being sung. In other embodiments of the song-matching system 10 of the present invention, the synthesizer 20 can be operative in response to the accompaniment signal $S_{ACC}$ to provide a harmony or a melody accompaniment, an instrumental accompaniment, or a non-articulated accompaniment (e.g., humming) that is transmitted from the output device OD in synchronism with the song being sung.

The stop signal 18*ss* from the matching module 18 deactivates the audio processing module 14. Once the definition pattern. 16$PI_{SEQ}$ has been recognized as the first portion of one of the relative pitch templates [X]$TMP_{RP}$ of the song database 12, it is an inefficient use of resources to continue running the audio processing, analyzing, and matching modules 14, 16, 18.

There is a likelihood that the pitch of the identified song [$X_M$] being transmitted as the accompaniment audio signal from the output device OD is different from the pitch of the song being sung. A further embodiment of the song-matching system 10 according to the present invention includes a pitch-adjusting module 22. Pitch-adjusting modules are known in the art. See, e.g., U.S. Pat. No. 5,811,708. The pitch-adjusting module 22 is operative, in response to the accompaniment signal 18$S_{ACC}$ from the song database 12 and a pitch adjustment signal 16pas from the analyzing module 16, to adjust the pitch of the unmatched portion of the relative pitch template [$X_M$]$TMP_{RP}$ of the identified song [$X_M$]. That is, the output of the pitch-adjusting module 22 is a pitch-adjusted accompaniment signal $S_{ACC\text{-}PADJ}$. The synthesizer module 20 is further operative to convert this pitch-adjusted digital signal to one of the accompaniment audio signals described above, but which is pitch-adjusted to the song being sung so that the accompaniment audio signal transmitted from the output device OD is in synchronism with and at substantially the same pitch as the song being sung.

FIG. 3 depicts one preferred embodiment of a method 100 for recognizing a song being sung and providing an audio accompaniment signal in synchronism therewith utilizing the song-matching system 10 according to the present invention.

In a first step 102, a song database 12 containing a repertoire of songs is provided wherein each song is stored in the song database 12 as a relative pitch template $TMP_{RP}$.

In a next step 104 the song being sung is converted from variable acoustical waves to a digital signal 14*ds* via the audio processing module 14. The audio input module may include whatever is required to acquire an audio signal from a microphone and convert the signal into sampled digital values. In preferred embodiments, this included a microphone preamplifier and an analog-to-digital converter. Certain microcontrollers, such as the SPCE-series from Sunplus, include the amplifier and analog-to-digital converter internally. One of skill in the art will recognize that the sampling frequency will determine the accuracy with which it is possible to extract pitch information from the input signal. In preferred embodiments, a sampling frequency of 8 KHz is used.

In a preferred embodiment, step 104 may comprise a number of sub-steps, as shown in FIG. 3, designed to improve signal $\mathbf{14}_{ds}$. Because the human singing voice has rich timbre and includes strong harmonics above the frequency of its fundamental pitch, a preferred embodiment of the system 10 uses a low-pass filter 210 to remove the harmonics. For example, a $4^{th}$ order Chebychev 500-Hz IIR low-pass filter is used for processing women's voices, and a $4^{th}$ order Chebychev 250-Hz IIR low-pass filter is used for processing men's voices. For a device designed for childrens' voices, a higher cutoff frequency may be necessary. In other embodiments, the filter parameters may be adjusted automatically in real time according to input requirements. Alternatively, multiple low-pass filters may be run in parallel and the optimal output chosen by the system. Other low-pass filters such as an external switched-capacitor low-pass filter such as Maxim MAX7410 or a low-cost op-amp can also be used.

In addition to the low-pass filter 210, the preferred embodiment employs an envelope-follower 220 to allow the system 10 to compensate for variations in the amplitude of the input signal. In its full form, the envelope-follower 220 produces one output 222 that follows the positive envelope of the input signal and one output 224 that follows the negative envelope of the input signal. These outputs are used to adjust the hysteresis of the schmitt-trigger that serves as a zero-crossing detector, described below. Alternative embodiments may include RMS amplitude detection and negative hysteresis control input of the schmitt-trigger 230.

The signals 222 & 224 from the low-pass filter 210 (and the envelope follower 220) are then input into the schmitt-trigger 230. The schmitt-trigger 230 serves to detect zero crossings of the input signal. For increased reliability, the schmitt-trigger 230 provides positive and negative hysteresis at levels set by its hysteresis control inputs. In certain embodiments, for example, the positive and negative schmitt-trigger thresholds are set at amplitudes 50% of the corresponding envelopes, but not less than 2% of full scale. When the schmitt-trigger input exceeds its positive threshold, the module's output is true; when the schmitt-trigger input falls below its negative threshold, its output is false; otherwise its output remains in the previous state. In other embodiments, the Schmitt-trigger floor value may be based on the maximum (or mean) envelope value instead of a fixed value, such as 2% of full-scale.

The schmitt-trigger 230 is the last stage of processing that involves actual sampled values of the original input signal. This stage produces a binary output (true or false) from which later processing derives a fundamental pitch. In certain preferred embodiments, the original sample data is not referenced past this point in the circuit.

In step 106, the digital signal 14*ds* is analyzed to detect the values of individual pitch events, to determine the interval between adjacent pitch events, i.e., to define a definition pattern $\mathbf{16}PI_{SEQ}$ of the song being sung as captured by the audio processing module 14. The duration of individual pitch events is also determined in step 106. FIG. 4 shows a preferred embodiment of step 106.

In the preferred embodiment, the output from the schmitt-trigger 230 is then sent to the cycle timer 310, which measures the duration in circuit clocks of one period of the input signal, i.e. the time from one false-true transition to the next. When that period exceeds some maximum value, the cycle-timer 310 sets its SPACE? output to true. The cycle-timer 310 provides the first raw data related to pitch. The main output of the cycle-timer is connected to the median-filter 320, and its SPACE? output is connected to the SPACE? input of both the median-filter 320 and the note-detector 340.

In the preferred embodiment, a median-filter 320 is then used to eliminate short bursts of incorrect output from the cycle-timer 310 without the smoothing distortion that other types of filter, such as a moving average, would cause. A preferred embodiment uses a first-in-first-out (FIFO) queue of nine samples; the output of the filter is the median value in the queue. The filter is reset when the cycle timer detects a space (i.e. a gap between detectable pitches).

In a preferred embodiment, the output from the median filter 320 is input to a pitch estimator 330, which converts cycle times into musical pitch values. Its output is calibrated in musical cents relative to C0, the lowest definite pitch on any standard instrument (about 16 Hz). An interval of 100 cents corresponds to one semitone; 1200 cents corresponds to one octave, and represents a doubling of frequency.

The pitch estimator 330 then feeds into a note detector 340. The note detector 340 operates on pitches to create events corresponding to intentional musical notes and rests. In the preferred embodiment, the pitch estimator 330 buffers pitches in a queue and examines the buffered pitches. In the preferred embodiment, the queue holds six pitch events (cycle times). When the note-detector receives a SPACE?, a rest-marker is output, and the note-detector queue is cleared. Otherwise, when the note-detector receives new data (i.e., a pitch estimate), it stores that data in its queue. If the queue holds a sufficient number of pitch events, and those pitches vary by less than a given amount (e.g. a max-note-pitch-variation value), then the note detector 340 proposes a note whose pitch is the median value in the queue. If the proposed new pitch differs from the pitch of the last emitted note by more than a given amount (e.g. min-new-note-delta value), or if the last emitted note was a rest-marker, then the proposed pitch is emitted as a new note. As described above, the pitch of a note is represented as a musical interval relative to the pitch of the previous note.

As shown in FIG. 4, the input of the note detector 340 is connected to the output of the pitch estimator 330; its SPACE? input is connected to the SPACE? output of the cycle timer 310; and its output is connected to the SONG MATCHER.

In alternative embodiments, the note detector may be tuned subsequent to the beginning of an input, as errors in pitch tend to decrease after the beginning of an input. In still other embodiments, the pitch estimator 330 may only draw input from the midpoint in time of the note.

In alternative embodiments of the present invention, various filters can be added to improve the data quality. For example, a filter may be added to declare a note pitch to be valid only if supported by two adjacent pitches with, for example, 75 cents or a majority of pitches in the median-filter buffer. Similarly, if the song repertoire is limited to contain only songs having small interval jumps (e.g., not more than a musical fifth), a filter can be used to reject large pitch changes. Another filter can reject pitches outside of a predetermined range of absolute pitch. Finally, a series of pitches separated by short dropouts can be consolidated into a single note.

Song Matcher

Next, in step 108 the definition pattern of the song being sung is compared with relative pitch templates $TMP_{RP}$ of each song stored in the song database 12 to recognize one song in the song database corresponding to the song being sung. Song recognition is a multi-step process. First, the definition pattern $16PI_{SEQ}$ is pattern matched against each relative pitch template $TMP_{RP}$ to assign correlation scores to each prerecorded song in the song database. These correlation scores are then analyzed to determine whether any correlation score exceeds a predetermined confidence level, where the predetermined confidence level as been established as the pragmatically-acceptable level for song recognition, taking into account uncertainties associated with pattern matching of pitch intervals in the song-matching system 10 of the present invention.

In the preferred embodiment, the system 10 uses a sequence (or string) comparison algorithm to compare an input sequence of relative pitches and/or relative durations to a reference pattern stored in song library 12. This comparison algorithm is based on the concept of edit distance (or edit cost), and is implemented using a standard dynamic programming technique known in the art. The matcher computes the collection of edit operations—insertions, deletions or substitutions—that transforms the source string (here, the input notes) into the target string (here, one of the reference patterns) at the lowest cost. This is done by effectively examining the total edit cost for each of all the possible alignments of the source and target strings. (Details of one implementation of this operation is available in *Melodic Similarity: Concepts, Procedures, and Applications*, W. B. Hewlett and E. Selfridge-Field, editors, The MIT Press, Cambridge, Mass., 1998, which is hereby incorporated by reference). Similar sequence comparison methods are often applied to the problems of speech recognition and gene identification, and one of skill in the art can apply any of the known comparison algorithms.

In the preferred embodiment, each of the edit operations is assigned a weight or cost that is used in the computation of the total edit cost. The cost of a substitution is simply the absolute value of the difference (in musical cents) between the source pitch and the target pitch. In the preferred embodiment, insertions and deletions are given costs equivalent to substitutions of one whole tone (200 musical cents).

Similarly, the durations of notes can be compared. In other embodiments, the system is also able to estimate the user's tempo by examining the alignment of user notes with notes of the reference pattern and then comparing the duration of the matched segment of user notes to the musical duration of the matched segment of the reference pattern.

Confidence in a winning match is computed by finding the two lowest-scoring (that is, closest) matches. When the difference in the two best scores exceeds a given value (e.g. min-winning-margin value) and the total edit cost of the lower scoring match does not exceed a given value (e.g. max-allowed-distance value), then the song having the lowest-scoring match to the input notes is declared the winner. The winning song's alignment with the input notes is determined, and the SONG-PLAYER is directed to play the winning song starting at the correct note index with the current input pitch. Also, it is possible to improve the determination of the pitch at the system joins the user by examining more than the most recent matched note. For example, the system may derive the song pitch by examining all the notes in the user's input that align with corresponding notes in the reference pattern (edit substitutions) whose relative pitch differences are less than, for example, 100 cents, or from all substitutions in the 20th percentile of edit distance.

In other embodiments, the system may time-out if a certain amount of time passes without a match, or after some number of input notes have been detected without a match. In alternative embodiments, if the system 10 is unable to identify the song, the system can simply mimic the user's pitch (or a harmony thereof) in any voice.

Song Player

Once a song in the song database has been recognized as the song being sung, in step 110 the unmatched portion of the relative pitch template of the recognized song is downloaded from the song database as a digital accompaniment signal to the synthesizer module 20. In step 112, the digital accompaniment signal is converted to an audio accompaniment signal, e.g., the unsung original sounds of the recognized song. These unsung original sounds of the identified song are then broadcast from an output device OD in synchronism with the song being sung in step 114.

In the preferred embodiment the SONG PLAYER takes as its input: song index, alignment and pitch. The song index specifies which song in the library is to be played; alignment specifies on which note in the song to start (i.e. how far into the song); and-pitch specifies the pitch at which to play that note. The SONG PLAYER uses the stored song reference pattern (stored as relative pitches and durations) to direct the SYNTHESIZER to produce the correct absolute pitches (and musical rests) at the correct time. In certain embodiments, the SONG PLAYER also takes an input related to tempo and adjusts the SYNTHESIZER output accordingly.

In other embodiments, each song in the song library may be broken down into a reference portion used for matching and a playable portion used for the SONG PLAYER. Alternatively, if the SONG MATCHER produces a result beyond a certain portion of a particular song, the SONG PLAYER may repeat the song from the beginning.

Synthesizer

In the preferred embodiment, the SYNTHESIZER implements wavetable-based synthesis using a 4-times oversampling method. When the SYNTHESIZER receives a new pitch input, it sets up a new sampling increment (the fractional number of entries by which the index in the current wavetable should be advanced). The SYNTHESIZER sends the correct wavetable sample to an audio-out module and updates a wavetable index. The SYNTHESIZER also handles musical rests as required.

In other embodiments, amplitude shaping (attack and decay) can be adjusted by the SYNTHESIZER or multiply wavetables for different note ranges, syllables, character voices or tone colors can be employed.

Auido Output Module

The AUDIO OUTPUT MODULE may include any number of known elements required to convert an internal digital representation of song output into an acoustic signal in a loudspeaker. This may include a digital-to-analog-converter and amplifier, or those elements may be included internally in a microcontroller.

One of skill in the art will recognize numerous uses for the instant invention. For example, the capability to identify a song can be used to control a device. In another variation, the system 10 can "learn" a new song not in its repertoire by listening to the user sign the song several times and the song can be assimilated into the system's library 12.

A variety of modifications and variations of the above-described system and method according to the present invention are possible. It is therefore to be understood that, within the scope of the claims appended hereto, the present invention can be practiced other than as specifically described herein.

What is claimed is:

1. A song-matching system providing real-time, dynamic recognition of a song being sung and providing an audio accompaniment signal in synchronism therewith, comprising:

a song database having a repertoire of songs, each song of the database being stored as a relative pitch template;

an audio processing module operative in response to the song being sung to convert the song being sung into a digital signal;

an analyzing module operative in response to the digital signal to determine a definition pattern representing a sequence of pitch intervals of the song being sung that have been captured by the audio processing module;

a matching module operative to compare the definition pattern of the song being sung with the relative pitch template of each song stored in the song database to recognize one song in the song database as the song being sung;

the matching module being further operative to cause the song database to download the unmatched portion of the relative pitch template of the recognized song as a digital accompaniment signal; and a synthesizer module operative to convert the digital accompaniment signal to the audio accompaniment signal that is transmitted in synchronism with the song being sung.

2. The song-matching system of claim 1 wherein the audio accompaniment signal comprises yet to be sung original sounds of the recognized song.

3. The song-matching system of claim 1 wherein the audio accompaniment signal comprises a harmony accompaniment.

4. The song-matching system of claim 1 wherein the audio accompaniment signal comprises a melody accompaniment.

5. The song-matching system of claim 1 wherein the audio accompaniment signal comprises an instrumental accompaniment.

6. The song-matching system of claim 1 wherein the audio accompaniment signal comprises a non-articulated accompaniment.

7. The song-matching system of claim 1 wherein the matching module implements one or more one pattern-matching events wherein each song of the database is assigned a correlation score based upon the comparison of the definition pattern with its relative pitch template and processes the correlation scores until a single correlation score meets or exceeds a predetermined confidence level, wherein the one song in the song database corresponding to the song being sung is recognized.

8. The song-matching system of claim 1 further comprising:

a pitch-adjusting module operative to adjust the pitch of the digital accompaniment signal to be substantially the same as the pitch of the song being sung wherein the audio accompaniment signal is transmitted from the output device in synchronism with and at substantially the same pitch as the song being sung.

9. The song-matching system of claim 1 wherein the matching module is operative to compare in parallel the definition pattern of the song being sung with the relative pitch templates of all of the songs in the song database to recognized the one song in the song database as the song being sung.

10. A song-matching system providing real-time, dynamic recognition of a song being sung and providing an audio accompaniment signal in synchronism therewith, comprising:

a song database having a repertoire of songs, each song of the database being stored as a relative pitch template;

an audio processing module operative in response to the song being sung to convert the song being sung to a digital signal;

an analyzing module operative in response to the digital signal to determine a definition pattern representing a sequence of pitch intervals of the song being sung that has been captured by the audio processing module;

a matching module operative to compare the definition pattern of the song being sung with the relative pitch template of each song stored in the song database to recognize one song in the song database as the song being sung;

the matching module being further operative to cause the song database to download the unmatched portion of the relative pitch template of the recognized song as a digital accompaniment signal;

a pitch-adjusting module operative to adjust the pitch of the digital accompaniment signal to be substantially the same as the pitch of the song being sung; and a synthesizer module operative to convert the pitch-adjusted digital accompaniment signal to a pitch-adjusted audio accompaniment signal and to transmit the pitch-adjusted audio accompaniment signal in synchronism with and at substantially the same pitch as the song being sung.

11. The song-matching system of claim 10 wherein the matching module is operative to compare in parallel the definition pattern of the song being sung with the sequences of pitch events of all of the songs in the song database to recognize the one song in the song database as the song being sung.

12. A real-time, dynamic recognition method for recognizing a song being sung and providing an audio accompaniment signal in synchronism therewith utilizing a song-matching system, comprising the steps of:

providing a song database for the song-matching system having a repertoire of songs wherein each song is stored in the song database as a relative pitch template;

converting the song being sung to a digital signal;

analyzing the digital signal to determine a definition pattern for the song being sung representing a sequence of pitch intervals of the sung being sung that have been captured by the song-matching system;

comparing the definition pattern of the song being sung with the relative pitch template of each song stored in the song database to recognize one song in the song database corresponding to the song being sung;

downloading the unmatched portion of the relative pitch template of the recognized song as a digital accompaniment signal;

converting the digital accompaniment signal to the audio accompaniment signal; and transmitting the audio accompaniment signal from an output device in synchronism with the song being sung.

13. The method of claim 12 wherein the comparing step comprises:

Implementing one or more pattern-matching events wherein each song of the database is assigned a correlation score based upon the comparison of the definition pattern with its relative pitch template; and Processing the correlation scores until a single correlation score meets or exceeds a predetermined confidence level wherein the single correlation score defines the one song in the song database recognized as the song being sung.

14. The method of claim 12 further comprising the step of:

adjusting the pitch of the digital accompaniment signal to be substantially the same as the pitch of the song being sung wherein the audio accompaniment signal transmitted from the output device is in synchronism with and at substantially the same pitch as the song being sung.

* * * * *